US009114450B2

(12) United States Patent
Chen et al.

(10) Patent No.: US 9,114,450 B2
(45) Date of Patent: Aug. 25, 2015

(54) HANDLING MECHANISM AND PUNCHING MACHINE USING THE SAME

(75) Inventors: Wen-Sheng Chen, Shenzhen (CN); Zhen-Hua Xu, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 664 days.

(21) Appl. No.: 13/438,182

(22) Filed: Apr. 3, 2012

(65) Prior Publication Data

US 2013/0118225 A1 May 16, 2013

(30) Foreign Application Priority Data

Nov. 11, 2011 (CN) ..... 2011 1 0356904

(51) Int. Cl.
*B21D 43/02* (2006.01)

(52) U.S. Cl.
CPC ..... *B21D 43/02* (2013.01)

(58) Field of Classification Search
CPC ..... B21D 43/105; B21D 43/10; B21D 43/02; B21J 13/08; B21J 13/10
See application file for complete search history.

(56) References Cited

U.S. PATENT DOCUMENTS 5,964,119 A * 10/1999 Kutschker ..... 72/306

FOREIGN PATENT DOCUMENTS

| | | |
|---|---|---|
| CN | 201493366 U | 6/2010 |
| CN | 102085656 A | 6/2011 |
| TW | 201124244 A | 7/2011 |

* cited by examiner

*Primary Examiner* — Teresa M Ekiert
(74) *Attorney, Agent, or Firm* — Novak Druce Connolly Bove + Quigg LLP

(57) ABSTRACT

A handling mechanism to convey workpieces, includes a mounting seat, a first sliding member, a first driving assembly, a second sliding member, a second driving assembly, and a clamping assembly. The first sliding member is slidably mounted on the mounting seat. The first driving assembly is mounted on the mounting seat and capable of driving the first sliding member to slide along the longitudinal direction of the mounting seat. The second sliding member is slidably mounted on the first sliding member. The second driving assembly is mounted on the first sliding member and capable of driving the second sliding member to slide along a direction perpendicular to the longitudinal direction of the mounting seat. The clamping assembly is fixed to the second sliding member for clamping workpieces. The present invention further discloses a punching machine using the same.

8 Claims, 6 Drawing Sheets

HANDLING MECHANISM AND PUNCHING MACHINE USING THE SAME

BACKGROUND

1. Technical Field

The present disclosure relates to handling mechanisms, and more particularly, to a handling mechanism used in a punching machine.

2. Description of Related Art

A conventional punching machine employs a handling mechanism to convey workpieces. One conventional handling mechanism includes a mounting seat, a driving assembly mounted on the mounting seat, and a sliding member driven by the driving assembly. However, the sliding member is merely capable of sliding relative to the mounting seat along one direction. In order to convey workpieces along two perpendicular directions, a robot has to be employed to work with the punching machine. However, the robot has a complicated structure, and the cost of the robot is relatively high.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
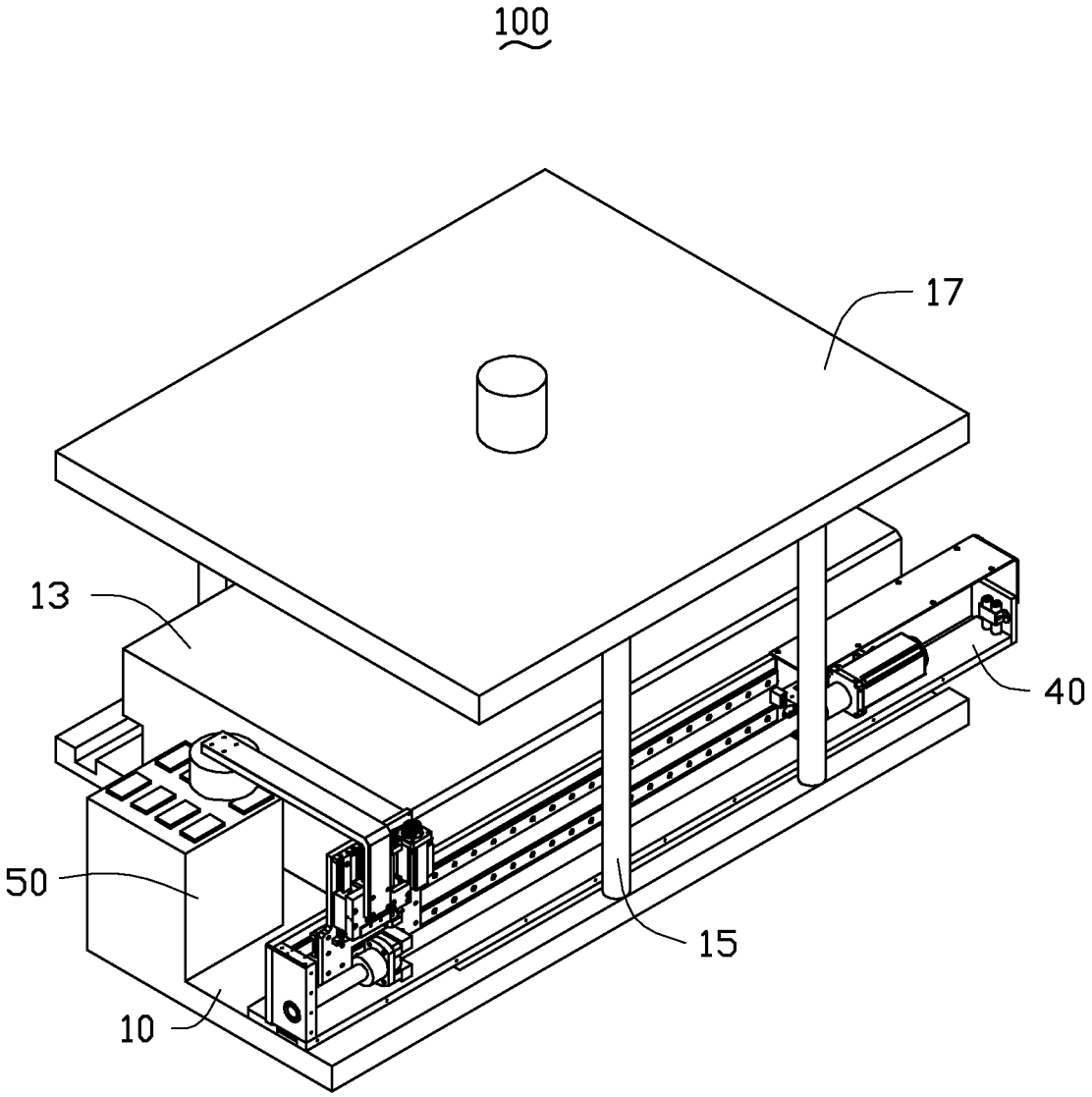
FIG. 1 is an isometric view of an embodiment of a punching machine.
Figure 2:
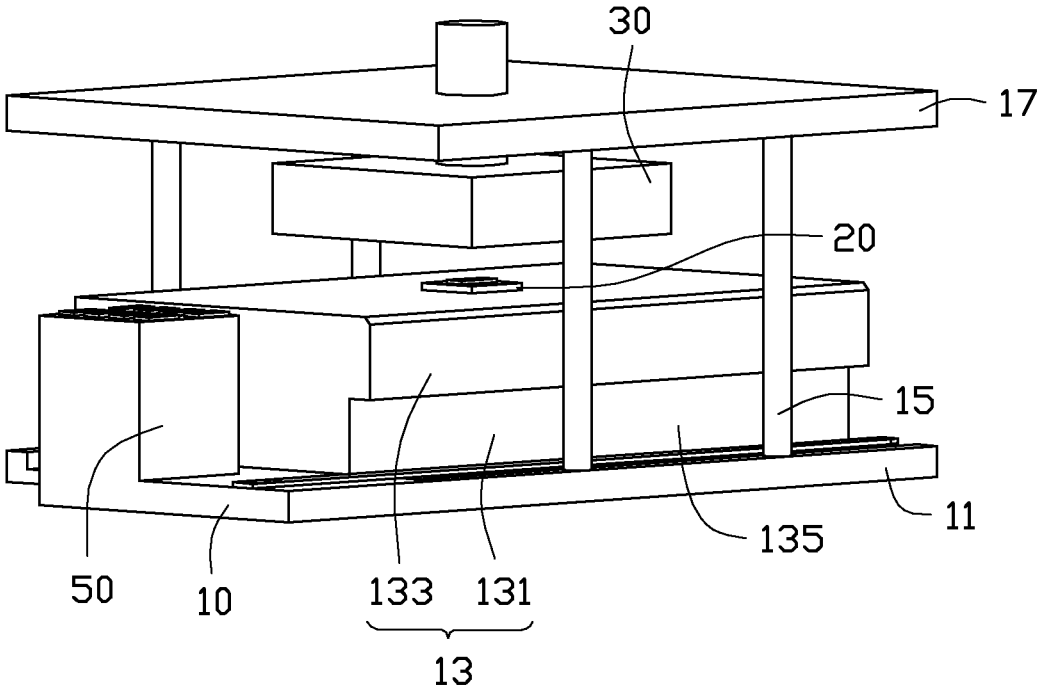
FIG. 2 is similar to FIG. 1, but viewed from another aspect without a handling mechanism.

Referring to FIGS. 1 and 2, an embodiment of a punching machine 100 includes a base seat 10, a lower mold 20, an upper mold 30, a driver (not shown), a handling mechanism 40, and a workpiece feeding table 50. The lower mold 20 and the handling mechanism 40 are fixed on the base seat 10 and positioned adjacent to each other. The handling mechanism 40 clamps a workpiece from the workpiece feeding table 50 and positions the workpiece on the lower mold 20. The upper mold 30 is movably mounted over the lower mold 20 and connects with the driver. The upper mold 30 is driven by the driver and capable of punching the workpiece on the lower mold 20.

The base seat 10 includes a bottom plate 11, a support table 13, a plurality of support posts 15, and an upper plate 17. The bottom plate 11 is substantially a rectangular plate. The support table 13 is mounted on a middle portion of the bottom plate 11, and includes a support portion 131 and a bearing portion 133 connected to the support portion 131. The support portion 131 is fixed on the bottom plate 11, and the bearing portion 133 protrudes out from a top portion of a side surface of the support portion 131. A width of the bearing portion 133 is greater than that of the support portion 131 and forms two mounting spaces 135 at two sides of the support portion 131 for assembling the handling mechanism 40. The plurality of support posts 15 is mounted on two sides of the bottom plate 11 to support the upper plate 17. The upper plate 17 is a substantially rectangular plate, and fixed on a top end of the support post 15. The upper plate 17 is parallel to the bottom plate 11.

The lower mold 20 is substantially mounted on the middle portion of the bearing portion 133 of the support table 13. The upper mold 30 is movably mounted on the upper plate 17 and connects with the driver. The upper mold 30 is capable of moving toward the support table 13 and punching the workpiece on the support table 13.

Figure 3:
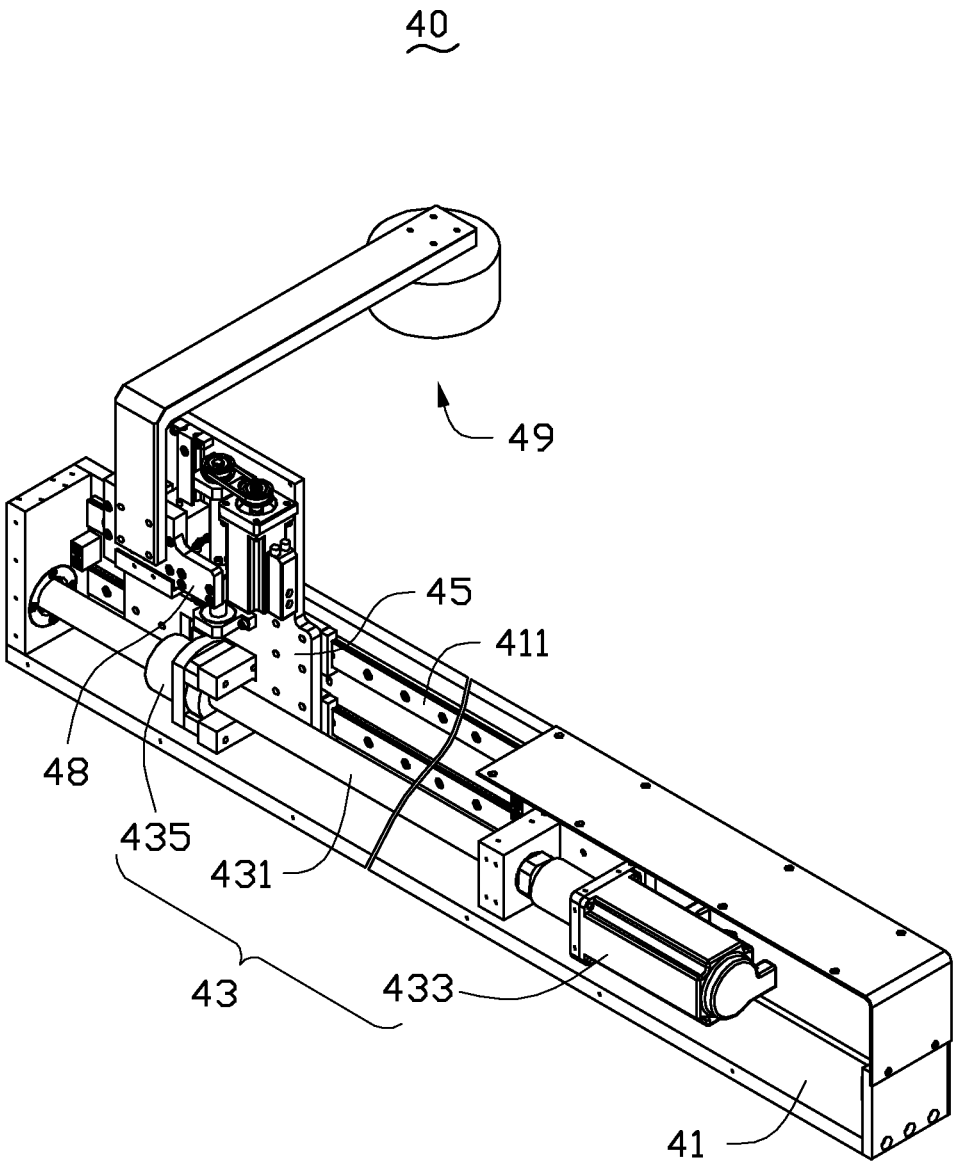
FIG. 3 is an isometric view of a handling mechanism of the punching machine of FIG. 2.
Figure 4:
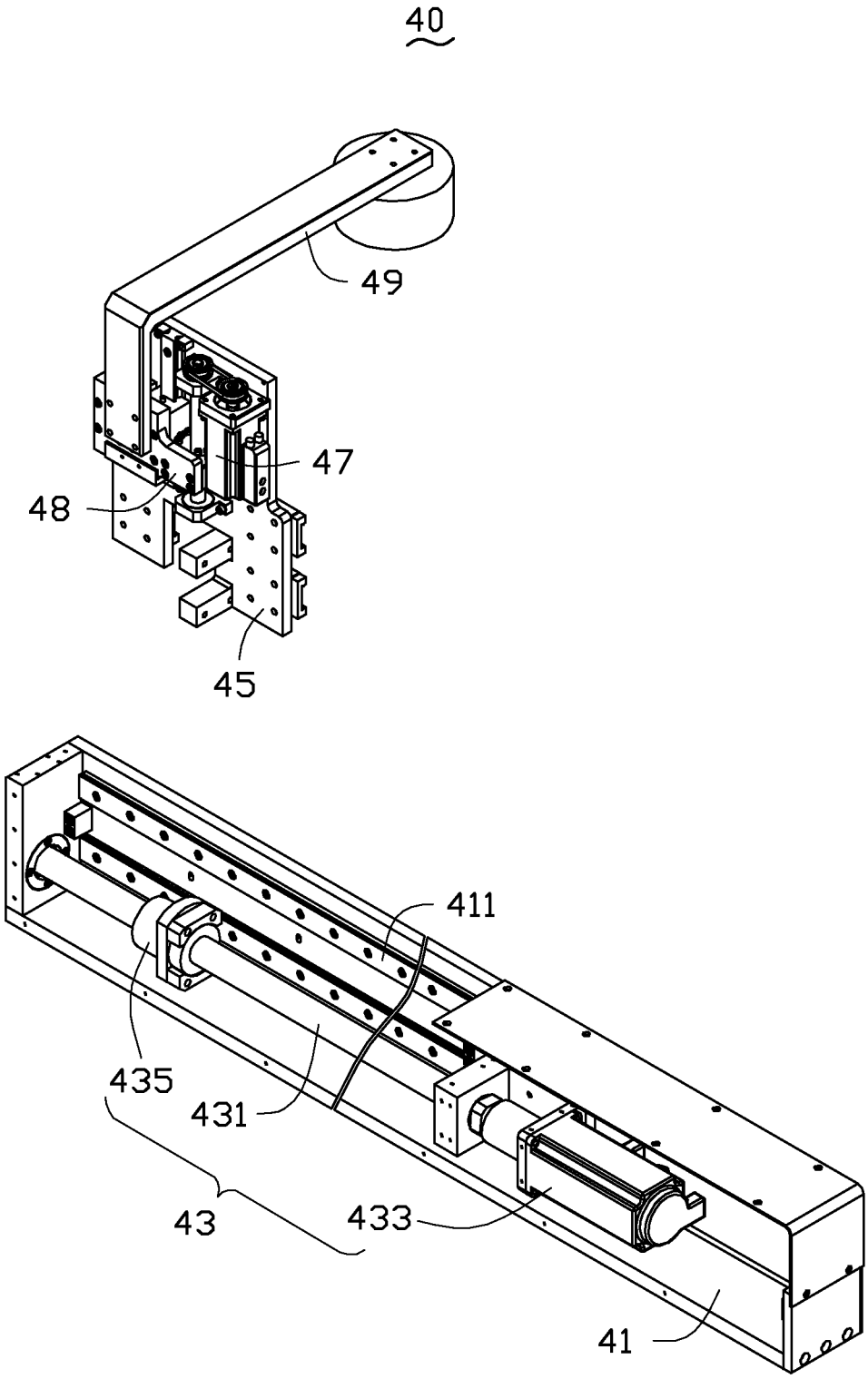
FIG. 4 is an exploded, isometric view of the handling mechanism of FIG. 3, the handling mechanism including a first driving assembly, a first sliding member, a second driving assembly, a second sliding member and a clamping assembly.

Also referring to FIGS. 3 and 4, the handling mechanism 40 is substantially rectangular and partially received in the mounting space 135. The handling mechanism 40 includes a mounting seat 41, a first driving assembly 43, a first sliding member 45, a second driving assembly 47, a second sliding member 48, and a clamping assembly 49. The first driving assembly 43 is mounted on the mounting seat 41, the first sliding member 45 is slidably mounted on the mounting seat 41 and driven by the first driving assembly 43. The second driving assembly 47 is mounted on the first sliding member 45. The second sliding member 48 is slidably mounted on the first sliding member 45 and driven by the second driving assembly 47. The clamping assembly 49 is fixed to the second sliding member 48 to clamp the workpieces.

The mounting seat 41 is in a strip shape and fixed to the bottom plate 11. The mounting seat 41 includes a pair of first guiding rails 411 along the longitudinal direction thereof. The pair of first guiding rails 411 is parallel to and spaced from each other.

The first driving assembly 43 includes a first lead screw 431, a first driver 433 and a first nut 435. The first lead screw 431 is mounted on the mounting seat 41 along the longitudinal direction of the mounting seat 41. The first lead screw 431 is substantially parallel to and spaced from the pair of first guiding rails 411. The first driver 433 is mounted on an end of the first lead screw 431 and capable of driving the first lead screw 431 to rotate. The first nut 435 is sleeved on the first lead screw 431 and capable of moving along the longitudinal direction of the first lead screw 431 when the first lead screw 431 rotates.

The first sliding member 45 is slidably engaging with the pair of first guiding rails 411. The first sliding member 45 defines a pair of first guiding grooves 451 thereof corresponding to the pair of first guiding rails 411. The pair of first guiding grooves 451 is substantially parallel to each other and each receives one of the first guiding rails 411, respectively. The first sliding member 45 includes a pair of second guiding rails 453 at a side thereof opposite to the first guiding grooves 451. The longitudinal direction of the second guiding rails 453 is perpendicular to that of the pair of first guiding grooves 451, the cross section of the second guiding rail 453 is substantially in a swallowtail shape.

Figure 5:
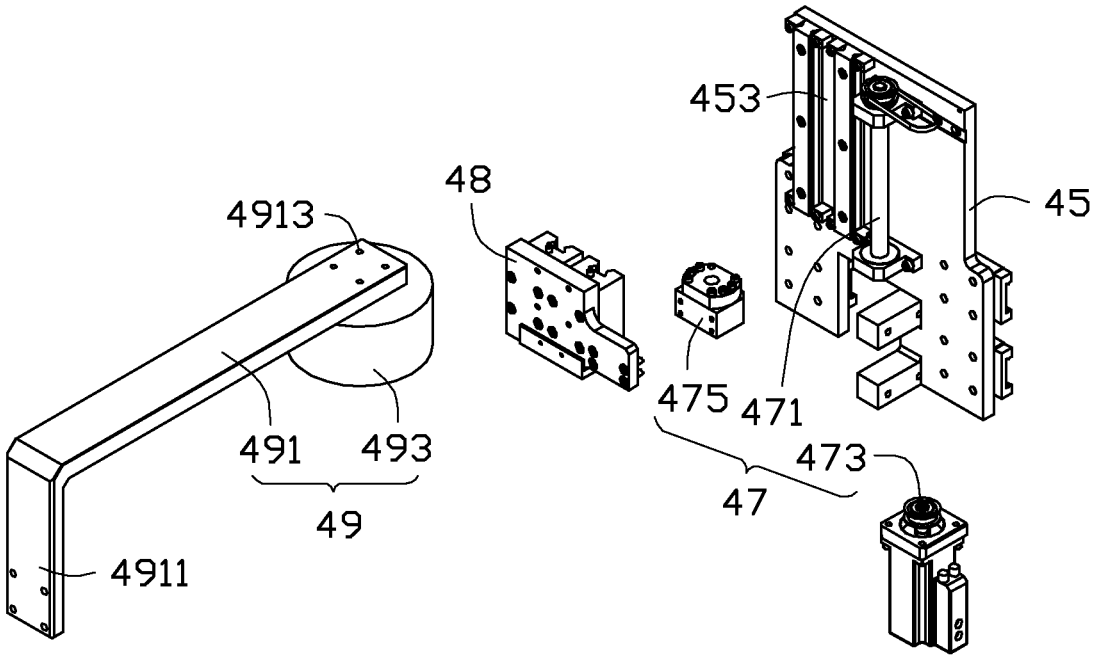
FIG. 5 is an enlarged, exploded isometric view of the first sliding member, the second driving assembly, the second sliding member and the clamping assembly of the handling mechanism of FIG. 3.
Figure 6:
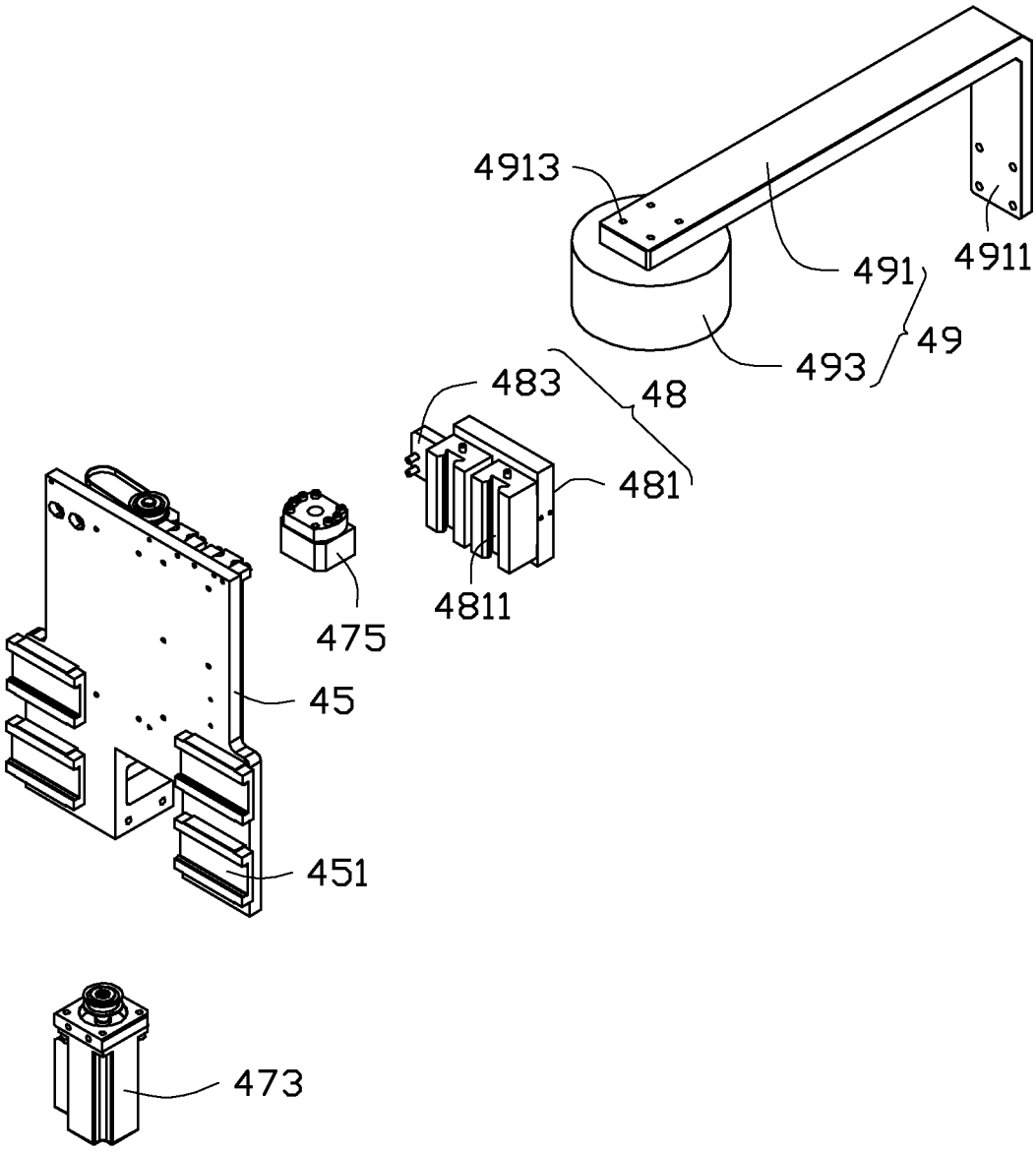
FIG. 6 is similar to FIG. 5, but viewed from another aspect.

Also referring to FIGS. 5 and 6, the second driving assembly 47 includes a second lead screw 471, a second driver 473, and a second nut 475. The second lead screw 471 and the second driver 473 are mounted on the first sliding member 45 adjacently. The second nut 475 is sleeved on the second lead screw 471.

The second lead screw 471 and the second driver 473 are substantially parallel to the pair of second guiding rails 453. The second lead screw 471 is positioned adjacent to the pair of second guiding rails 453. The second driver 473 is positioned away from the pair of second guiding rails 453 and connects with the second lead screw 471 via a driver belt (not labeled). The second nut 475 engages with the second lead screw 471 and is capable of moving along the longitudinal direction of the second lead screw 471.

The second sliding member 48 is fixed to the second nut 475. The second sliding member 48 includes a main body 481 and an extending portion 483 protruded from a side of the main body 481. The main body 481 defines a pair of second guiding grooves 4811 thereof. The pair of second guiding rails 453 of the first sliding member 45 is received in the pair of second guiding grooves 4811 of the second sliding member 48 respectively. The extending portion 483 of the second sliding member 48 is fixed to the second nut 475. In the illustrated embodiment, the main body 481 includes two blocks (not labeled) joined together. The two second guiding grooves 4811 are defined on the two blocks respectively. It should be noted that, the main body 481 may be in other shape, such as an entire block define a pair of second guiding grooves 4811 thereon.

The clamping assembly 49 is fixed to the second sliding member 48. The clamping assembly 49 includes a support plate 491 and a clamping member 493 connected to an end of the support plate 491. The support plate 491 is in a "L" shape, and includes a fixing end 4911 and a support end 4913 perpendicular to the fixing end 4911. The fixing end 4911 is fixed to a side of the main body 481 opposite to the pair of second guiding grooves 4811. The support end 4913 extends away from the main body 481 and has a length greater than that of the fixing end 4911. The clamping member 493 is fixed to an end portion of the support end 4913 for clamping a work piece.

The workpiece feeding table 50 is located at a side of the bottom plate 11 for receiving workpiece.

When in assembly, the lower mold 20, the upper mold 30, and the driver are mounted on the bottom plate 11. The clamping assembly 49 is mounted on the second sliding member 48, and the second sliding member 48 and the second driving assembly 47 are mounted on the first sliding member 45. The first sliding member 45 is fixed to the first nut 435 and slidably mounted on the mounting seat 41. The first driving assembly 43 is mounted on the mounting seat 41. The mounting seat 41 is mounted on the bottom plate 11 to complete the assembling of the punching machine 100.

When in use, a plurality of pre-punching workpieces are settled on the workpiece feeding table 50. The first driver 433 drives the first lead screw 431 to rotate, then the first nut 435 drives the first sliding member 45 to slide along the pair of first guiding rails 411. When the first sliding member 45 approaches the workpiece feeding table 50, the second driver 473 drives the second lead screw 471 to rotate, and then the second nut 475 drives the support plate 491 to slide along the pair of second guiding rails 453. The support end 4913 drives the clamping member 493 to move toward the workpiece feeding table 50 along a direction perpendicular to the bottom plate 11. Then the clamping member 493 clamps one pre-punching workpiece and the handling mechanism 40 positions the one pre-punching workpiece on the lower mold 20. The support plate 491 returns to the workpiece feeding table 50. The upper mold 30 punches the pre-punching workpiece on the lower mold 20, and then the support plate 491 drives the clamping member 493 to move toward the after-punching workpiece on the lower mold 20. The clamping member 493 clamps the after-punching workpiece and places it on the workpiece feeding table 50. The punching machine 100 works in this manner in cyclic operation.

The first sliding member 45 is capable of sliding along the pair of first guiding rails 411, the second sliding member 48 is capable of sliding along the pair of second guiding rails 453, thus the clamping assembly 49 fixed to the second sliding member 48 is capable of sliding along two perpendicular directions relative to the mounting seat 41. In adopting such components, the handling mechanism 40 is simpler and the cost is decreased. The handling mechanism 40 is in a strip shape and received in the mounting space 135, such that the entire occupied volume of the punching machine 100 is smaller. The second sliding member 48 engages with the first sliding member 45 via the second guiding rails 453 received in the two second guiding grooves 4811 respectively, such that the support plate 491 is capable of engaging with the first sliding member 45 firmly. The deformation of the support plate 491 is decreased and the positioning accuracy of the handling mechanism 40 is improved.

The number of the second guiding grooves 4811 may be one or more, the number of the second guiding rails 453 may be changed accordingly.

The punching machine 100 may further include a receiving station located at a side of the bottom plate 11 opposite to the workpiece feeding table 50. The handling mechanism 40 is capable of handling pre-punching workpieces from the workpiece feeding table 50 to the lower mold 20 and transmits the after-punching workpiece to the receiving station.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A handling mechanism for handling one or more workpieces, comprising:

a mounting seat, wherein the mounting seat comprises a pair of first guiding rails arranged along a longitudinal direction thereof;

a first sliding member slidably mounted on the mounting seat, wherein the first sliding member defines a pair of first guiding grooves thereof, the pair of first guiding rails is received in the pair of first guiding grooves respectively to enable the first sliding member slidably engaging with the mounting seat, and the first sliding member comprises a pair of second guiding rails at a side opposite to the first guiding grooves, a longitudinal direction of the second guiding rails is perpendicular to that of the pair of first guiding grooves;

a first driving assembly mounted on the mounting seat, the first driving assembly being capable of driving the first sliding member to slide along a longitudinal direction of the mounting seat;

a second sliding member slidably mounted on the first sliding member, wherein the second sliding member comprises a main body and an extending portion protruded from a side of the main body, the main body defines a pair of second guiding grooves thereof, the pair of second guiding rails is received in the pair of second guiding grooves respectively to enable the second sliding member slidably engage with the first sliding member;

a second driving assembly mounted on the first sliding member, the second driving assembly being capable of driving the second sliding member to slide along a direction perpendicular to the longitudinal direction of the mounting seat; wherein the second driving assembly comprises a second lead screw, a second driver and a second nut, the second lead screw is parallel to the pair of second guiding rails and positioned adjacent to the pair of second guiding rails, the second driver is positioned away from the pair of second guiding rails and connects with the second lead screw, the second nut is fixed to the extending portion and engages with the second lead screw and is capable of moving along the longitudinal direction of the second lead screw when the second lead screw rotates; and a clamping assembly fixed to the second sliding member for clamping the workpieces.

2. The handling mechanism of claim 1, the first driving assembly comprises a first lead screw, a first driver and a first nut, the first nut is fixed to the first sliding member, the first lead screw is mounted on the mounting seat and parallel to the pair of first guiding rails, the first driver is mounted on an end of the first lead screw and capable of driving the first lead screw to rotate, the first nut is sleeved on the first lead screw and capable of moving along the longitudinal direction of the first lead screw when the first lead screw rotates.

3. The handling mechanism of claim 1, wherein the clamping assembly comprises a support plate and a clamping member connected to an end of the support plate, the support plate comprises a fixing end and a support end perpendicular to the fixing end, the fixing end is perpendicular fixed to the main body of the second sliding member, the support end extends away from the main body, and the clamping member is fixed to the support end.

4. A punching machine, comprising:

a base seat;

a workpiece feeding table mounted on a side of the base seat;

a lower mold mounted on the base seat;

an upper mold located above the lower mold; and a handling mechanism comprising:

a mounting seat mounted on the base seat adjacent to the workpiece feeding table, wherein the mounting seat comprises a pair of first guiding rails arranged along a longitudinal direction thereof;

a first sliding member slidably mounted on the mounting seat, wherein the first sliding member defines a pair of first guiding grooves thereof, the pair of first guiding rails is received in the pair of first guiding grooves respectively to enable the first sliding member slidably engaging with the mounting seat, and the first sliding member comprises a pair of second guiding rails at a side opposite to the first guiding grooves, a longitudinal direction of the second guiding rails is perpendicular to that of the pair of first guiding grooves;

a first driving assembly mounted on the mounting seat, the first driving assembly being capable of driving the first sliding member to slide along the longitudinal direction of the mounting seat;

a second sliding member slidably mounted on the first sliding member, wherein the second sliding member comprises a main body and an extending portion protruded from a side of the main body, the main body defines a pair of second guiding grooves thereof, the pair of second guiding rails is received in the pair of second guiding grooves respectively to enable the second sliding member slidably engage with the first sliding member;

a second driving assembly mounted on the first sliding member, the second driving assembly being capable of driving the second sliding member to slide along a direction perpendicular to the mounting seat; wherein the second driving assembly comprises a second lead screw, a second driver and a second nut, the second lead screw is parallel to the pair of second guiding rails and positioned adjacent to the pair of second guiding rails, the second driver is positioned away from the pair of second guiding rails and connects with the second lead screw, the second nut is fixed to the extending portion and engages with the second lead screw and is capable of moving along the longitudinal direction of the second lead screw when the second lead screw rotates; and a clamping assembly fixed to the second sliding member for clamping workpiece from the workpiece feeding table.

5. The punching machine of claim 4, the first driving assembly comprises a first lead screw, a first driver and a first nut, the first nut is fixed to the first sliding member, the first lead screw is mounted on the mounting seat and parallel to the pair of first guiding rails, the first driver is mounted on an end of the first lead screw and capable of driving the first lead screw to rotate, the first nut is sleeved on the first lead screw and capable of moving along the longitudinal direction of the first lead screw when the first lead screw rotates.

6. The punching machine of claim 4, wherein the clamping assembly comprises a support plate and a clamping member connected to an end of the support plate, the support plate comprises a fixing end and a support end perpendicular to the fixing end, the fixing end is perpendicular fixed to the main body of the second sliding member, the support end extends away from the main body, and the clamping member is fixed to the support end.

7. The punching machine of claim 4, wherein the base seat comprises a bottom plate, an upper plate parallel to the bottom plate, a support table mounted on the bottom plate, and a plurality of support posts interconnecting with the bottom plate and the upper plate, the plurality of support posts are located at two sides of the bottom plate, the lower mold is mounted on the support table, and the mounting seat is mounted on the bottom plate adjacent to the support table.

8. The punching machine of claim 7, wherein the support table is located on a middle portion of the bottom plate, and comprises a support portion and a bearing portion connected to the support portion, the support portion is fixed to the bottom plate, the bearing portion is away from the bottom plate, a width of the bearing portion is greater than that of the support portion and forms two mounting spaces at two sides of the support portion, the mounting seat is partially received in one mounting space.

* * * * *